United States Patent [19]

Scott

[11] Patent Number: 4,615,061

[45] Date of Patent: Oct. 7, 1986

[54] POCKETED AND INTERCONNECTED UPPER AND LOWER SHEETS

[76] Inventor: Diane M. Scott, 2003 S. 138th Ave. Cir., Omaha, Nebr. 68144

[21] Appl. No.: 602,388

[22] Filed: Apr. 20, 1984

Related U.S. Application Data

[63] Continuation-in-part of Ser. No. 366,055, Apr. 6, 1982, abandoned.

[51] Int. Cl.[4] ..... A47G 9/04

[52] U.S. Cl. ..... 5/497; 5/500

[58] Field of Search ..... 5/497, 496, 498, 500, 5/482, 502, 495, 499, 485

[56] References Cited

U.S. PATENT DOCUMENTS

| | | | |
|---|---|---|---|
| 2,695,414 | 11/1954 | Ford et al. | 5/497 |
| 3,832,743 | 9/1974 | Smith | 5/496 |
| 3,857,124 | 12/1974 | Hadley | 5/496 |
| 3,962,739 | 6/1976 | Crocket | 5/497 |
| 4,035,854 | 7/1977 | Pardee | 5/497 |
| 4,145,778 | 3/1979 | Ferrante et al. | 5/496 |
| 4,266,308 | 5/1981 | Shatz | 5/497 |
| 4,344,196 | 8/1982 | Large | 5/496 |
| 4,384,380 | 5/1983 | Glaha et al. | 5/496 |

*Primary Examiner*—Alexander Grosz

*Attorney, Agent, or Firm*—Hiram A. Sturges

[57] ABSTRACT

A bed sheet combination comprising under and upper sheets attached together by an elongated interlocking means assembly extending along foot portions of the sheets, the sides of the sheets being free of connecting means for speed of interconnecting of the under and upper sheets, both sheets having pocketed foot-ends, the pockets of the upper sheet being for protecting the elongated interlocking means from stress from sheet-tugging, the pockets of the upper sheet having elastic edges to provide pockets which expand for speedy attachment to a mattress.

9 Claims, 6 Drawing Figures

POCKETED AND INTERCONNECTED UPPER AND LOWER SHEETS

This application is a continuation-in-part of the applicant's co-pending patent application Ser. No. 06/366,055, filed 4-6-82, now abandoned, and titled BED SHEET COMBINATION.

BACKGROUND OF THE INVENTION

Although combination bed sheets with the under sheet attached to the upper sheet have been proposed numerous times in the prior art, none of the earlier concepts have ever been marketed, to my knowledge.

The reason for this, in my opinion, is that a combination bed sheet must have the possibility of speedy attachment to the mattress and speedy attachment of its upper sheet to its lower sheet, and the capability of speedy detachment of its upper sheet from its lower sheet, and also, a predictable durability for years of service.

The public has had much experience with breakage of zippers. A zipper can become separated, even when its sides are interlocked, provided there is stress on it. The stitchings of a zipper can become torn from adjacent material when there is substantial stress on it, and substantial stress can easily occur in a product of this type, resultant from persons tugging on bed sheets in pulling them toward the head of the bed.

An objective hereof is to provide such a product with a predictably good durability by the provision of pockets on the upper sheet for taking the stress of such sheet tugging so as to relieve the zipper and its stitchings of such stress.

A pocketed upper sheet has been proposed in the prior art in a non-zippered two-sheet combination and hence proposed not for the purpose of protecting a zipper, the pockets proposed being of a non-elastic type. Such a proposal is shown in U.S. Pat. No. 4,344,196, issued Aug. 17, 1982 to Hellen F. Large.

For these reasons, it is an object of this invention to provide a bed sheet combination that is provided with a single zipper extending along the foot of the bed only and with the sides of the sheets free of interconnecting means so that a minimum of unzipping is necessary and speed of unzipping and zipping is possible.

The foot-end portions of the sheets hereof are free of impediments for fast positioning of the sheets into use positions.

A feature not present in the Large patent and present herein is the provision of having the side edges of the upper sheet being capable of extending continuously from the upper pockets toward the head end of a mattress sufficiently as to have the capability of a continuous presence adjacent a sleeper's feet at the sides of the upper sheet.

Another feature not present in Large is elastic upper sheet pockets which are present in this invention to allow for expansion of a pocket during its application to a mattress for speedy installation. Elastic material in upper sheet pockets has been shown in prior art U.S. Pat. No. 3,962,739, issued June 15, 1976 to Lou Anne Crockett. However, in the Crockett patent there is no zipper to protect by means of pockets, and removability of the upper sheet from the lower sheet is not provided for.

Of interest is U.S. Pat. No. 3,857,124, issued Dec. 31, 1974, to Belva D. Hadley for a sleeping bag type of double sheet arrangement, but without pockets to protect the zipper, and without capability of single zipper sheet disconnection and economy and speed of a single zipper at the foot-end.

Also of interest is a U.S. Pat. No. 3,832,743, issued 9-3-74, to Saundra L. Smith, titled BED SHEETS, but lacking pockets to protect the zipper.

Of importance as regards the Crockett patent is the need for seperability. Many women would be reluctant to buy a sheet combination as it would seem to them to be too cumbersome for their washing maching, two sheets at once especially if king-size.

Also non-seperability has a disadvantage because a tear in only one sheet then wastes two sheets.

DESCRIPTION OF THE PREFERRED EMBODIMENT

Figure 1:
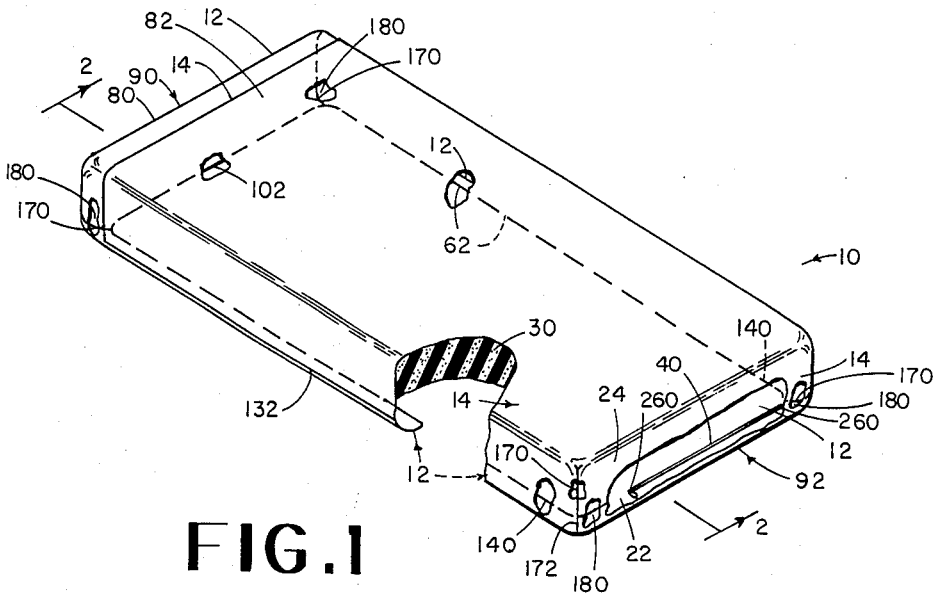
FIG. 1 is a perspective view of a bed mattress having the bed sheet assembly of this invention thereon, portions being broken away for revealing the other portions therebeneath.

The bed sheet assembly of this invention is generally indicated at 10 in FIG. 1 and comprises an under sheet 12 and an upper sheet 14 at least partially above and covering the under sheet 12.

The under sheet 12 has a first terminal end portion or foot portion 22 which is extendable in use position across a mattress 30 at the foot of the bed, the remainder of the bed not being shown.

The upper sheet 14 has a first end portion or foot portion 24 disposable in a position covering the first terminal end portion 22 of the under sheet 12 when on the mattress.

An elongated zipper assembly 40 having two elongated side sections 42 and 44 and a moveable section having a handle 52 is provided with the handle disposed on the zipper side sections in a manner for securing them together as the handle is moved from one end to the other of the zipper in a conventional manner, and to cause them to separate from each other in a conventional manner.

The zipper side sections 42 and 44 are attached to respective ones of the end portions 22 and 24 of the sheets 12 and 14. It is preferred that such attachment be done by means of thread stitching which is of different colors. In other words, the stitching 50 which connects the zipper side section 42 to the under sheet first terminal end portion 22 could be one color, such as green stitching and the stitching 51 which connects the upper zipper side section 44 to the upper sheet first terminal end section 24 can likewise be green. In this way, if the under sheet 12 and the upper sheet 14 are both white, then they can be matched up ready for zippering by matching the green stitching 50 with the green stitching 52 of the matching sheets.

Another set of sheets could have purple stitching. Still another set of sheets could have yellow stitching, for example. The under sheet first terminal end portion 22 has, as a lower part thereof, an under sheet tucking portion 62, best seen in FIG. 2, but also seen in FIG. 1. The tucking portion 62 extends from the zipper assembly 40 in a first and downward direction for the insertion of at least a portion thereof under the mattress 30. The under sheet 12 and the upper sheet 14 each have a main portion 80 and 82 respectively, as seen at the upper end of FIG. 1 and extending from the zipper assembly 40 each in a second direction at first upward and then horizontally and, in both cases, transversely of the elongation of the zipper assembly 40; in both cases, extending a much greater distance than the under sheet tucking portion 62 extends from the zipper assembly 40, whereby the main portions are adapted to be disposed above at least the majority of the area of the top of the mattress 30. However, the preferred construction is that the under sheet main portion 80 extend completely across the top of the mattress, whereby portions of the under sheet 12 which are at the head end 90 of the mattress are duplicates of portions thereof which are at the foot end 92 of the mattress, with the exception that the under sheet has no zipper attached thereto at the head end 90.

The head end 90 of the under sheet 12 terminates in a tucking portion 102, seen in FIG. 1, which extends under the mattress 30.

The upper sheet 14 has its main portion 82 preferably extending substantially to the head 90 of the bed mattress, but not wrapping around the head of the mattress.

The upper sheet 14 has a tucking portion 112 which extends under the foot end of the mattress and which wraps somewhat around the respective lower corners of the foot end 92 of the mattress in a conventional manner for the type of sheets that have tucking portions.

Figure 5:
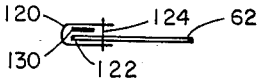
FIG. 5 is a sectional view showing a conventional binding at the terminal edge of the tucking portion of the sheet, the view being sectional similarly to FIG. 3, but enlarged. This is a diagrammatic view, since such bindings with an elastic piece inside are common in the prior art for sheet tucking portions.

Such conventional sheet tucking portions commonly have a binding 120 secured around the terminal edge 122 thereof, as best seen in FIG. 5. The binding 120 is held in place by binding stitching 124 extending through a portion of the binding which is above the tucking portion 62, through the tucking portion 62 itself, and through a portion of the binding which is under the tucking portion 62, whereby a conventional binding is substantially U-shaped in crosssection, as seen in FIG. 5.

Within the binding is a piece of elastic 130 which is loose all along the foot end of the bed and the elastic is, however, secured to the sheet portion 62 at places a few inches up toward the head end 90 of the bed from the lower end, such as approximately at a position 140 of FIG. 1, and the same is true of the opposite end of the elastic on the other side of the foot end of the bed. The same binding system of FIG. 5 is conventional to sheets having elastic at the top end or head end 90 of the bed, also; although, of course, the elastic 130 is not seen in the upper sheet 14 at its head end, but is repeated in indentical form at the head end 90 of the lower sheet.

Figure 2:
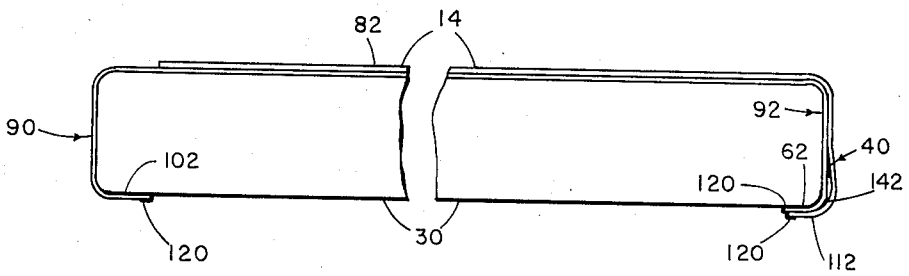
FIG. 2 is a sectional view taken along the line 2—2 of FIG. 1, with the exception that the mattress is shown from the side and, therefore, not shown in section, and with the exception that the sheets themselves are not shown in section lines because of the scale of the view. Therefore, is diagrammatic.

In FIG. 1, the lower edge of the top sheet 14 at the sides of the bed can be seen at 132 to substantially cover the mattress and the under sheet, but it is preferred that the upper sheet not extend under the mattress 30 along the major part of the length of the bed, even though it does at the foot end of the bed in order to round the corners at the foot end of the bed in a conventional manner to form a pocket seen at 142 in FIG. 2.

The same numeral 120 for binding shall be used for convenience, both on the bindings on the under sheet and the binding on the upper sheet.

The numerals 140 indicate the places where the elastic is secured by stitching at the ends of the elastic 30 so that it is free to draw together the tucking portion of the respective sheet as it clings to the underside of the foot end 92 of the bed.

Figure 3:
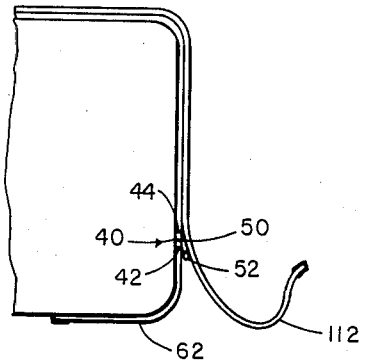
FIG. 3 is a sectional view of only the foot end of a bed as seen along the line 2—2 and with the under sheet in place, but with the upper sheet in the process of removal. The view is diagrammatic because the sheets are not shown in section because of the small scale. The view is also diagrammatic in that the mattress itself is shown from the side and not in section.

In FIG. 3, it can be seen that the removal of the upper sheet can be accomplished by pulling its tucking portion 112 away from the foot end of the bed, allowing it to swing upwardly. FIG. 3 is diagrammatic. By so pulling the bottom end of the upper sheet, the handle 52 is exposed, whereby unzipping can be done, if desired. However, many will not want to unzip anyway, and will simply leave the two sheets zipped together, next pulling loose the tucking portion 62 of the under sheet which can likewise be done at the head of the bed for removing the sheets in a conventional manner.

The tucking-type box sheets conventionally have a seam 170 at each corner of an under sheet, and a similar seam is found in each corner 172 of the upper sheet.

Although the zipper can function, even though it be adjacent the top of the foot end of the bed, yet it is preferred that it be in the lower fourth of the foot end of the mattress area, and in any case, at least preferably farther than one-fourth of the way from the top of the mattress to the bottom thereof. There is more freedom for the feet of the person sleeping in the bed if the zipper is disposed in the lower positions described.

It is also possible that the upper sheet and the under sheet be attached permanently without a zipper at all. In such a case, the zipper becomes an attachment means along an elongated area and, in a general sense, since no zipper need be used at all, form an attachment means in a different manner in this position.

Since the upper sheet and under sheet can be washed together successfully, the totally permanent attachment has no disadvantages that are serious, excepting when one of the sheets becomes worn out quicker than the other, in which latter case, one of the sheets might best be mated with a different mating sheet.

It is to be understood that the under and upper sheets herein can be formed of any kind of fabric, such as cotton, or even other materials.

Referring to FIG. 1, it will be seen that the upper sheet is not of any substantially greater width from left to right than the under sheet, even though conventionally the upper sheets hang down the side of a bed much farther than the bottom of the top mattress. In fact, as shown in FIG. 1, it is desired that the upper sheet hang down not substantially farther than the bottom of the mattress so that there is much less bulkiness in the top sheet, making for a great convenience in handling, since the mass of the two sheets is greater than handling two sheets separate, and also making possible use of the discovery that when the top sheet is not substantially wider than the bottom sheet that then the two sheets can be washed together at the same time in connected condition and will substantially not tangle to an undesirable extent. For example, it is desirable that the upper sheet terminate substantially at the bottom edge of the mattress or terminate at the sides of the bed within six inches of the bottom of the sides of the mattress.

Figure 6:
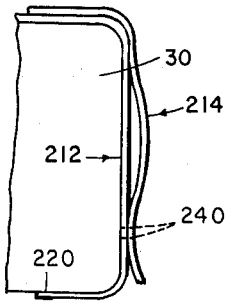
FIG. 6 is a diagrammatic view in all ways similar to FIG. 3, with the exception that it shows a modification of the invention in which two rows of stitching are substituted for the zipper assembly in attaching the under and upper sheets together, a lower portion of the upper sheet being broken away. The stitching can be understood to be coextensive in length with the zipper of FIG. 1 and in the same position.

This discovery makes it also practical for the permanent connection of the two sheets at all times and this is shown in the modification of FIG. 6 in which the under sheet 212 has an upper sheet 214 over it and the under sheet 212 is in all ways similar to the under sheet described in FIGS. 1 and 2. However, in the modification of FIG. 6 the upper sheet 214 is secured to the under sheet 212 by a double row of stitching 240, which latter extends horizontally along the bed in exactly the same positions described for the zipper assembly 40 hereinabove. The only difference is that the double row of stitching makes a permanent connection. The modification of FIG. 6 is similar to the modification of FIG. 1 in that the upper sheet can have the same construction in parts thereof disposed downwardly of the stitching 240 as does the sheet which is underneath in FIGS. 1 and 2.

Although pockets are preferred to cling to the mattress at both the bottom sheet and the top sheet, yet it will be seen that this invention has broader principles that will apply to sheets that are without pockets and that utilize simply a tucking portion of the under sheet at the least, or a tucking portion for the under sheet and the upper sheet at the most, such tucking portions optionally having pockets.

The seams 170 at each corner of the under sheet and the seams 172 at the foot end corners of the upper sheet are each of a height substantially equal to the height of the mattress which latter, conventionally, is three and three-fourths inches or six inches high.

The seams 170 and 172 each extend to the lowermost edge of the respective sheet. The lowermost edges of the right and left sides of the under sheet can extend downwardly from the top of the mattress to the extent shown or to a greater or lesser extent all along the right and left sides. It is only chiefly important that the right and left sides of the under sheet extend under the mattress at the head and foot ends of the mattress so as to form parts of the pockets 180 of the under sheet which latter are inwardly opening so as to receive the four lower corners of the mattress respectively.

Figure 4:
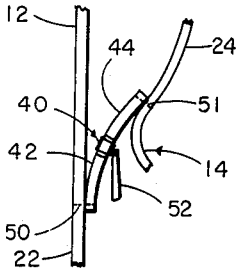
FIG. 4 is a sectional view similar to FIG. 3, but showing only portions adjacent the zipper. The parts are not shown in section because of the small scale so this view is diagrammatic.

The zipper assembly 40 of FIG. 4 and the stitchings 240 of FIG. 6 both can be described as an attachment assembly. Such an attachment assembly is preferably disposed extending in a straight horizontal line between two points 260 which are disposed at the right and left sides of the foot of the bed and which represent the endmost portions of the zipper 40 or the endmost portions of the stiching 240. The points 260 are preferably spaced inwardly from the seams 170 of the foot end of the under sheet a distance of about eight inches respectively to allow a freedom of removal of the foot end corners of the upper sheet from around the foot end corners of the mattress. The zipper is preferably about twenty-one inches long between the points 260 on a sheet combination of a size such that the right and left seams 170 are spaced apart about thirty-eight inches.

As seen in FIG. 2 and by studying FIG. 5 it can be seen that the effect of the elastic in the pockets in the top and bottom sheets will be to position the top sheets on the mattress and with respect to each other.

At the time all parts are in rest position on the mattress, the relative positions of under sheet, top sheet, and zipper assembly is such that pulling force, because of the top of the upper sheet towards the head of the bed, will be absorbed at the pockets of the top sheet instead of placing strain on the zipper and its connections to the sheets.

This is possible because there is slack in the zipper mounting strips when the sheets are in use, although the amount of the slack could be effective and yet might not be even visible and so is not illustrated. However a bending over of the zipper assembly because of its slack, when all parts are in use positions, would be a visible amount of slack and that much would be satisfactory also, if not so great as to be unsightly in pushing out the foot-end of the lower sheet and bedding.

The majority of, and preferably all, of the sides of said sheets are free of zipper and other sheet connection means for speed of disconnection.

The sides of the upper sheet extend continuously toward the head end thereof whereby if a foot of a sleeper were ajacent a side portion of said upper sheet it would be covered.

While zippers were specifically discussed, it is clear that other elongated interlocking means, such as hook and loop type fasteners, may be used to separably fasten the under sheet to the upper sheet.

Stress on the elongated interlocking means, and its connections to the sheets is avoided by positioning the side sections 42, 44, relative to the sheets and interlocking means, in such a way, that at times when the upper sheet pockets are in engagement with the mattress foot-end lower corners the side sections will have slack in them and will not be taut whereby a tugging on said upper sheet toward the head end of the mattress will put stress on said pockets of said upper sheet rather than putting stress on the elongated interlocking means and its connections to said sheets.

I claim:

1. A bed sheet assembly for reception on a box-shaped mattress having a horizontal top and a head end and a foot end which latter has a substantially vertical foot-end surface, comprising: an under sheet, an upper sheet positionable at least partially above and covering said under sheet, said under and upper sheets each having a foot-end section positionable in use on such a mattress vertically across said vertical foot-end surface of said mattress with the foot-end portion of said under sheet being between the mattress and said upper sheet, said under sheet and said upper sheet each having a top portion respectively attached to the tops of their vertically positionable foot-end sections for lying above a mattress, said under and upper sheets each having pockets adjacent lower corners of their foot-end portions capable of snugly receiving the lower corners of said foot-end of such a mattress, and a zipper attachment assembly attaching said respective ones of said vertically positionable foot-end sections together, said zipper attachment assembly comprising a horizontally positionable zipper attached at its sides respectively to first edges of zipper side sections of flexible material, said side sections each having second edges, said side sections being respectively attached adjacent their second edges respectively to said vertically positionable foot-end sections of said sheets, said zipper assembly being disposed along only said foot-end sections of said sheets, said sheets having sides the majority of the lengths of which are free of zipper means so as to make possible rapid disconnection of said upper and under sheets, said sheets each having elastic resilient means attached thereto and extending substantially along the terminal edge of the footend of the sheet whereby when said sheet is released said elastic tends to draw the terminal edge of the foot of each sheet into smaller pockets for fitting more tightly around respective corners of a mattress and whereby when said sheets are put on a mattress said elastic can be expanded for making the respective pockets temporarily large so as to be much more easily put on the mattress, the positions of attachment of said second edges of said side sections being such that at times when said upper sheet pockets are in engagement with said mattress foot-end lower corners said side sections will have slack in them and will not be taut whereby a tugging on said upper sheet toward the head end of said mattress will put stress on said pockets of said upper sheet rather than putting stress on said zipper and its connections to said sheets.

2. The bed sheet assembly of claim 1 having the entire length of the sides of said upper sheet free of sheet connection means.

3. The bed sheet combination of claim 1 in which at least one of the sides of the upper sheet extends substantially continuously toward the head-end of said upper sheet so that if a foot of a sleeper were adjacent that one side portion of said upper sheet, then that respective side portion of the upper sheet would substantially completely cover the said adjacent portion of the sleeper's foot.

4. A bed sheet assembly for reception on a box-shaped mattress having a horizontal top and a head end and a foot end which latter has a substantially vertical foot-end surface, comprising: an under sheet, an upper sheet positionable at least partially above and covering said under sheet, said under and upper sheets each having a foot-end section positionable in use on such a mattress vertically across said vertical foot-end surface of said mattress with the foot-end portion of said under sheet being between the mattress and said upper sheet, said under sheet and said upper sheet each having a top portion respectively attached to the tops of their vertically positionable foot-end sections for lying above a mattress, said under and upper sheets each having pockets adjacent lower corners of their foot-end portions capable of snugly receiving the lower corners of said foot-end of such a mattress, and an interlocking attachment assembly comprising an elongated interlocking means attached at its sides respectively to first edges of interlocking attachment assembly side sections of flexible material, said side sections each having second edges, said side sections being respectively attached adjacent their second edges respectively to said vertically positionable foot-end sections of said sheets, said interlocking attachment assembly being disposed along only said foot-end sections of said sheets, said sheets having sides the lengths of which are free of interlocking attachment means so as to make possible rapid disconnection of said upper and under sheets, said sheets each having elastic resilient means attached thereto and extending substantially along the terminal edge of the foot-end of the sheet whereby when said sheet is released said elastic tends to draw the terminal edge of the foot of each sheet into smaller pockets for fitting more tightly around respective corners of a mattress and whereby when said sheets are put on a mattress said elastic can be expanded for making the respective pockets temporarily large so as to be much more easily put on the mattress, the positions of attachment of said second edges of said side sections being such that at times when said upper sheet pockets are in engagement with said mattress foot-end lower corners said side sections will have slack in them and will not be taut whereby a tugging on said upper sheet toward the head end of said mattress will put stress on said pockets of said upper sheet rather than putting stress on said interlocking attachment assembly and its connections to said sheets.

5. The bed sheet combination of claim 4 in which at least one of the sides of the upper sheet extends substantially continuously toward the head-end of said upper sheet so that if a foot of a sleeper were adjacent that one side portion of said upper sheet, then that respective side portion of the upper sheet would substantially completely cover the said adjacent portion of the sleeper's foot.

6. A bed sheet assembly for reception on a box-shaped mattress having a horizontal top and a head end and a foot end which latter has a substantially vertical foot-end surface, comprising: an under sheet, an upper sheet positionable at least partially above and covering said under sheet, said under and upper sheets each having a foot-end section positionable in use on such a mattress vertically across said vertical foot-end surface of said mattress with the foot-end portion of said under sheet being between the mattress and said upper sheet, said under sheet and said upper sheet each having a top portion respectively attached to the tops of their vertically positionable foot-end sections for lying above a mattress, said under and upper sheets each having pockets adjacent lower corners of their foot-end portions capable of snugly receiving the lower corners of said foot-end of such a mattress, and an interlocking attachment assembly comprising a horizontally positionable elongated interlocking means attached at its sides respectively to first edges of interlocking attachment assembly side sections of flexible fabric material, said side sections each having second edges, said side sections being respectively attached adjacent their second edges respectively to said vertically positionable foot-end sections of said sheets, said sheets having sides the majority of the lengths of which are free of interlocking attachment means so as to make possible rapid disconnection of said upper and under sheets, said sheets each having elastic resilient means attached thereto and extending substantially along the terminal edge of the foot-end of the sheet whereby when said sheet is released said elastic tends to draw the terminal edge of the foot of each sheet into smaller pockets for fitting more tightly around respective corners of a mattress and whereby when said sheets are put on a mattress said elastic can be expanded for making the respective pockets temporarily large so as to be much more easily put on the mattress, the positions of attachment of said edges of said side sections being such that at times when said upper sheet pockets are in engagement with said mattress foot-end lower corners said side sections will have slack in them and will not be taut whereby a tugging on said upper sheet toward the head end of said mattress will put stress on said pockets of said upper sheet rather than putting stress on said interlocking attachment assembly and its connections to said sheets.

7. The bed sheet assembly of claim 6 having said interlocking attachment assembly means being hook and loop attachment assembly means.

8. The bed sheet assembly of claim 6 having said interlocking assembly means being a zipper attachment assembly.

9. The bed sheet combination of claim 6 in which at least one of the sides of the upper sheet extends substantially continuously toward the head-end of said upper sheet so that if a foot of a sleeper were adjacent that one side portion of said upper sheet, then that respective side portion of the upper sheet would substantially completely cover the said adjacent portion of the sleeper's foot.

* * * * *